United States Patent [19]

Matsui

[11] Patent Number: 4,846,618

[45] Date of Patent: Jul. 11, 1989

[54] YARN CONVEYING SYSTEM

[75] Inventor: Isamu Matsui, Kyoto, Japan

[73] Assignee: Murata Kikai Kabushiki Kaisha, Kyoto, Japan

[21] Appl. No.: 926,647

[22] Filed: Nov. 3, 1986

Related U.S. Application Data

[63] Continuation of Ser. No. 597,686, Apr. 6, 1984, abandoned.

[30] Foreign Application Priority Data

Apr. 11, 1983 [JP] Japan ..... 58-63930

[51] Int. Cl.[4] ..... B65H 5/00

[52] U.S. Cl. ..... 414/222; 198/465.2; 198/346.1; 209/927; 242/35.5 A; 57/276

[58] Field of Search ..... 414/222; 57/281, 276; 242/35.5 R, 35.5 A; 28/299; 139/1; 198/580, 465.2, 346.1; 209/927

[56] References Cited

U.S. PATENT DOCUMENTS

| | | | |
|---|---|---|---|
| 2,804,961 | 9/1957 | Carter | 198/580 X |
| 4,371,075 | 2/1983 | Erlichman | 198/465.2 X |
| 4,463,909 | 8/1984 | Kiriake et al. | 242/35.5 A |

*Primary Examiner*—Robert J. Spar
*Assistant Examiner*—Donald W. Underwood
*Attorney, Agent, or Firm*—Spensley Horn Jubas & Lubitz

[57] ABSTRACT

A yarn-conveying system in the route consisting of a fine spinning process, a rewinding process. A first closed loop is provided between a fine spinning machine and a winder for conveying cops or empty bobbins and a second closed loop is formed between the winder and a weaving machine for conveying packages and empty paper spools.

2 Claims, 16 Drawing Sheets

YARN CONVEYING SYSTEM

This is a continuation of application Ser. No. 597,686 filed on Apr. 6, 1984, now abandoned.

BACKGROUND OF THE INVENTION

1. Field of the Invention

The present invention relates to a yarn-conveying system, in particular to a yarn-conveying system in the route consisting of a fine spinning process, a rewinding process, and a weaving process.

2. Prior Art

In general, spinning yarns produced by a fine spinning machine, in particular by a representative ring spinning frame, are wound on a bobbin to be doffed in the form of "cop". The amount of yarn per a piece of cop is small owing to the mechanical restriction of said ring spinning frame itself. Accordingly, cops are once conveyed to a rewinding process to be rewound in the form of a cone package or a cheese package of the appointed size and shape by means of "a winder" and in this time the defects of yarns such as slubs, thick portions, and the like contained in yarns are removed. The packages having yarns rewound thereon in the above described manner are packed up to be transported to the textile manufacturing factories and then yarns are used as weft yarns of weaving machines of a type without shuttle, for example a rapier type weaving machine, fluid weaving machine, or the like, or fed to a warping machine to be used for warping warps.

Although such cop-conveyance and package-conveyance are effective for the mass production of little kinds of textile goods, they are not efficient for the production of many kinds of textile goods of a small quantity in the factory, where the operations are continuously carried out from spinning to weaving, since the packaging and the conveyance are complicated.

SUMMARY OF THE INVENTION

An object of the present invention is to provide a conveying system suitable for conveying many kinds of yarns, wherein the operations being continuously carried out from the spinning process to the weaving process by means of a continuous conveying system.

According to the present invention, a first closed loop of passages for conveying spinning yarns is installed between a spinning machine and a winder, and a second closed loop of passages for conveying rewound yarns between the winder and a weaving machine.

BRIEF DESCRIPTION OF THE DRAWINGS

FIGS. 18, 19 show one example of an empty paper spool supplying system for supplying empty paper spools to said winder, in which FIG. 18 is a diagram showing the relation between winding units and a travelling member, and FIG. 19 is a diagram showing the relation between an empty paper spool-conveying passage and said travelling member.

DETAILED DESCRIPTION OF THE INVENTION

The preferred embodiments of the present invention will be described below with reference to the drawings.

Figure 1:
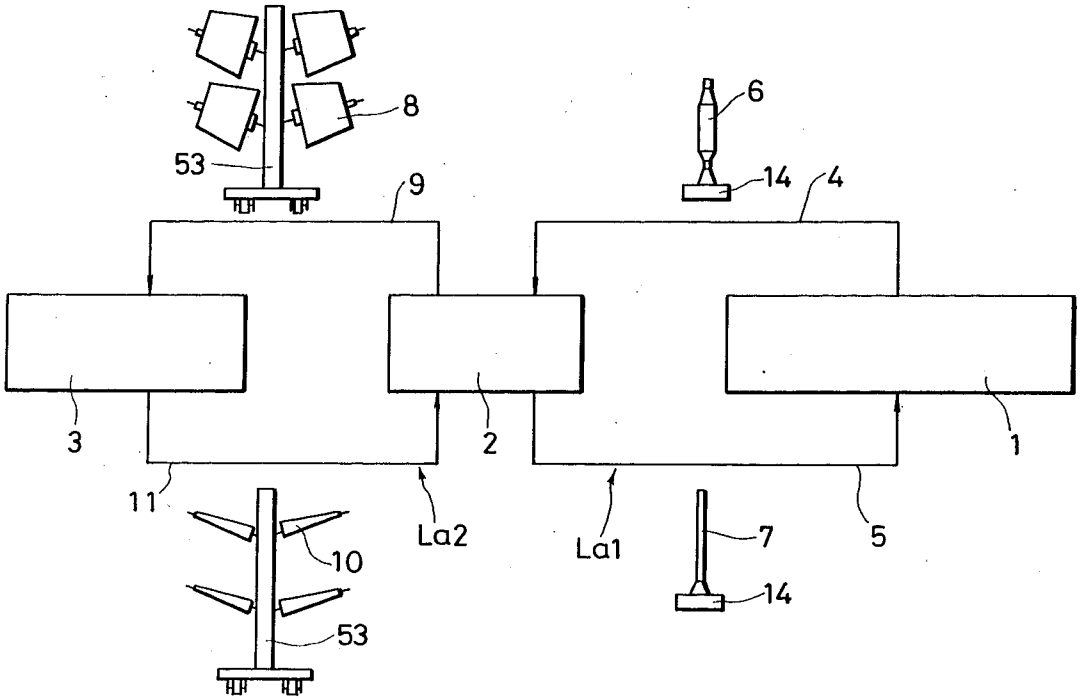
FIG. 1 is a diagram showing the first preferred embodiment of the system according to the present invention.

Referring now to FIG. 1, which is a schematic drawing showing a system according to the present invention, the first closed loop La1, which consists of a cop-conveying passage 4 and an empty bobbin-conveying passage 5, is formed between a fine spinning machine 1 represented by a ring spinning frame and an automatic winder 2, spinning yarns produced by said fine spinning machine 1 being wound around bobbins, then they being conveyed toward said automatic winder 2 through said cop-conveying passage 4 in the form of cops 6, and cops being successively fed to each winding unit of said winder 2 to be rewound. An empty bobbin 7, from which yarns were rewound by said winder 2, is returned from said winder 2 to said fine spinning machine 1 along said empty bobbin-conveying passage 5 and then fed to each fine spinning unit of said fine spinning machine 1 in order to wind spinning yarns therearound again..

One the other hand, said automatic winder 2 is connected with a weaving machine 3 by means of the second closed loop La2 consisting of a package-conveying passage 9 for conveying a package 8, around which the appointed quantity, that is to say the appointed length of yarn is wound, to said weaving machine 3 and an empty paper spool-conveying passage 11 for returning an empty paper spool 10 made empty by using yarns, which are wound around a paper spool, as weft yarns in said weaving machine 3 to said winder 2 again.

Figure 3:
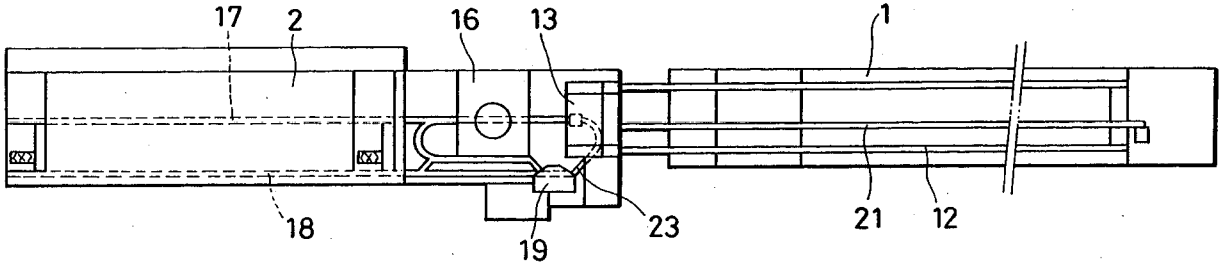
FIG. 3 is a plan showing the winder shown in FIG. 2.
Figure 2:
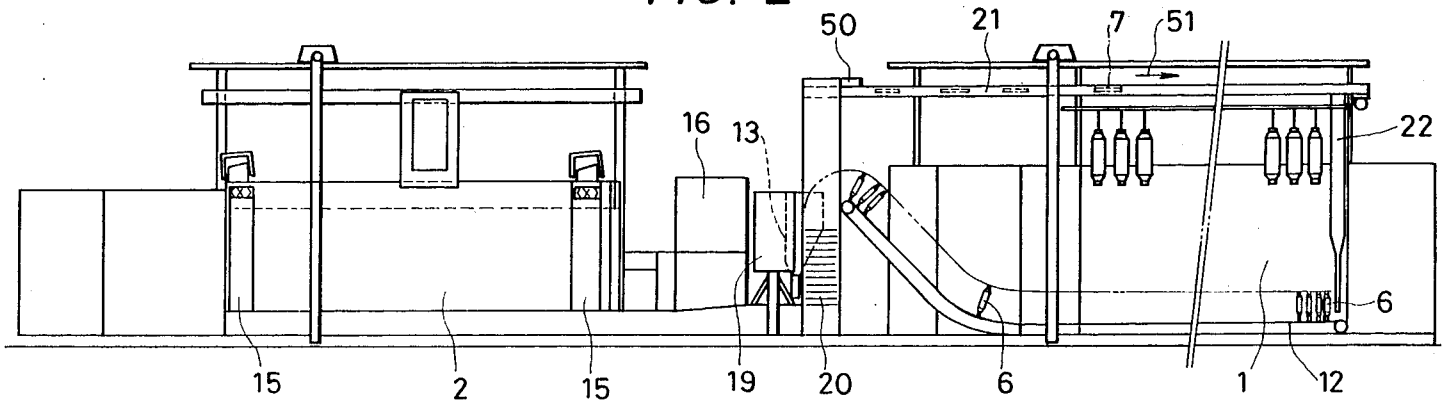
FIG. 2 is an outlined front view showing one example of a winder composing the first closed loop in the system shown in FIG. 1.

Then FIGS. 2, 3 show the preferred embodiment of a cop-conveying means composing said first closed loop connecting said fine spinning machine with said winder. That is to say, cops, around which spinning yarns produced by said fine spinning machine 1 were wound, are fixedly inserted into pegs on for example a transport band 12 and transported longitudinally along said fine spinning machine 1. Then said cops are thrown into a cop-supplying apparatus 13 followed by being vertically inserted in a cop-conveying means, which holds itself in readiness under said cop-supplying apparatus 13, for example a peg-tray 14 (FIG. 1), which is being transported on a belt conveyor, to be supplied to each winding unit 15 of said winder 2. 16 denotes a yarn end readying device for seeking and releasing a yarn end from cops, which have been treated by said fine spinning machine 1, a sensor for detecting the existence of a cop-layer, or the like.

The cops are supplied to each winding unit of said winder 2 by supplying cops inserted in said peg-tray separately from a cop-conveyor 17 to the winding position of each unit. Empty bobbins, which finished the winding, or bobbins with the residual yarn are transported by means of an empty bobbin-conveyor 18 installed along said winding units, empty bobbins being separated from bobbins with the residual yarn by means of a bobbin-treatment apparatus 19, and empty bobbins, which were pulled out of said peg-tray by means of said bobbin-treatment apparatus 19, being transported upwardly by means of an empty bobbin-lifting apparatus 20 and then transported horizontally by means of an empty bobbin-conveying passage 21 extending longitudinally over said fine spinning machine. An empty bobbin 7 is dropped in a chute 22 and stored therein when transported to the end portion of said fine spinning machine and then supplied to an empty peg on said transport band 12, which is installed below said chute 22, with timing to be fixedly inserted therein. On the other hand, an empty peg-tray, which was emptied by pulling an empty bobbin or a bobbin with the residual yarn, is further transported to said cop-supplying apparatus 13 by means a conveyor 23, where said empty peg tray is supplied with a cop again.

The first closed loop La1, in which said fine spinning machine 1 is connected with said winder 2 through said cop-conveying passage 17 and said empty bobbin-conveying passage 18, is formed in this manner.

Figure 4:
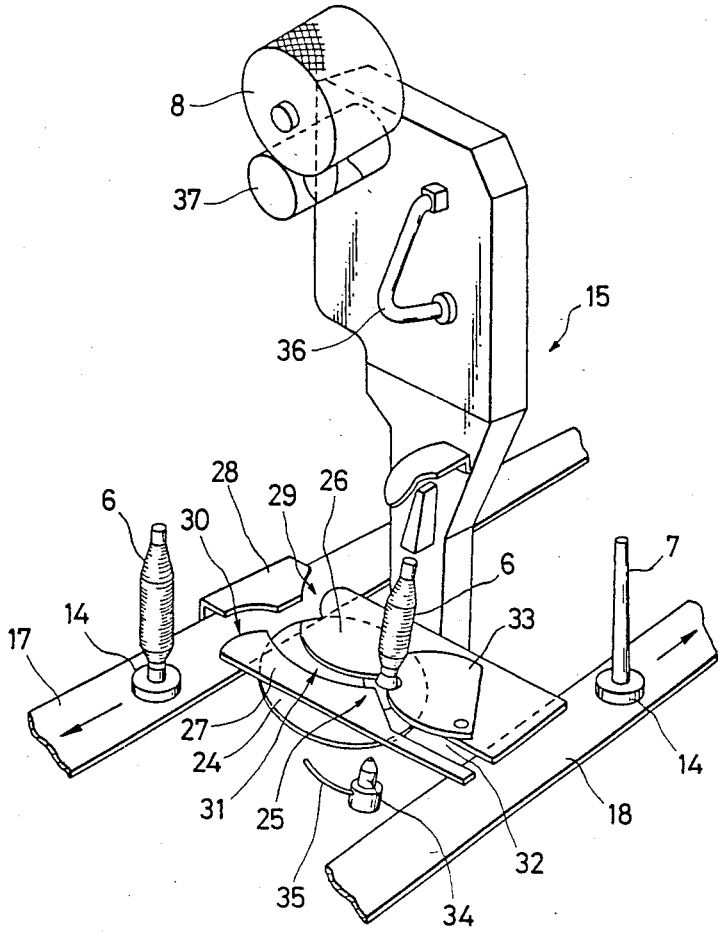
FIG. 4 is a perspective view showing one example of a winding unit composing the winder.

FIG. 4 shows one example of a winder used in the above described system. That is to say, a plurality of winding unit 15 are installed side by side with each other to form said winder 2 and said winding units 15 are installed between said cop-conveying passage 17 and said empty bobbin-conveying passage 18. 24 denotes a rotary disc for transporting a cop, which is on said cop-conveying passage 17, to the rewinding position 25 and ejecting an empty bobbin onto said empty bobbin-conveying passage 18, said rotary disc 24 being provided with guide plates 26, 27 with the definite interval on the upper portion thereof to form an inlet 29 of cop and an outlet 30 of an excess cop between said guide plate 26 and other guide plate 28 and cop stand-by line 31 and a bobbin-ejecting line 32 between said guide plate 26 and said guide plate 27. The position, where said cop stand-by line 31 is connected with said bobbin-ejecting line 32 is said rewinding position 25. 33 denotes a lever for ejecting an empty bobbin or a bobbin with the residual yarn.

A pressurized air-spraying nozzle 34, which is communicated with a pressurized air source (not shown) through a conduit 35 below the tray, which is at the above described rewinding position 25, the pressurized air sprayed out of said nozzle 34 being sprayed from an arched slit (not shown) formed in said rotary disc 24 into the inside of a core tube of cops through the space inside space of a peg of said tray 14 to blow the end of yarn, which is hung down in said core tube from the upper end thereof, up to the upper portion of the outside of said core tube. The blown up end of yarn is sucked and hold by a relay pipe 36 which holds itself in readiness at the position above said cop 6 existing at said rewinding position 25, and then turned upwardly to be introduced into a knotter for knotting the yarn end of package side with the yarn end of cop side. Thus the rewinding is begun. 37 denotes a twilling drum, 8 denotes a wound package.

Figure 5:
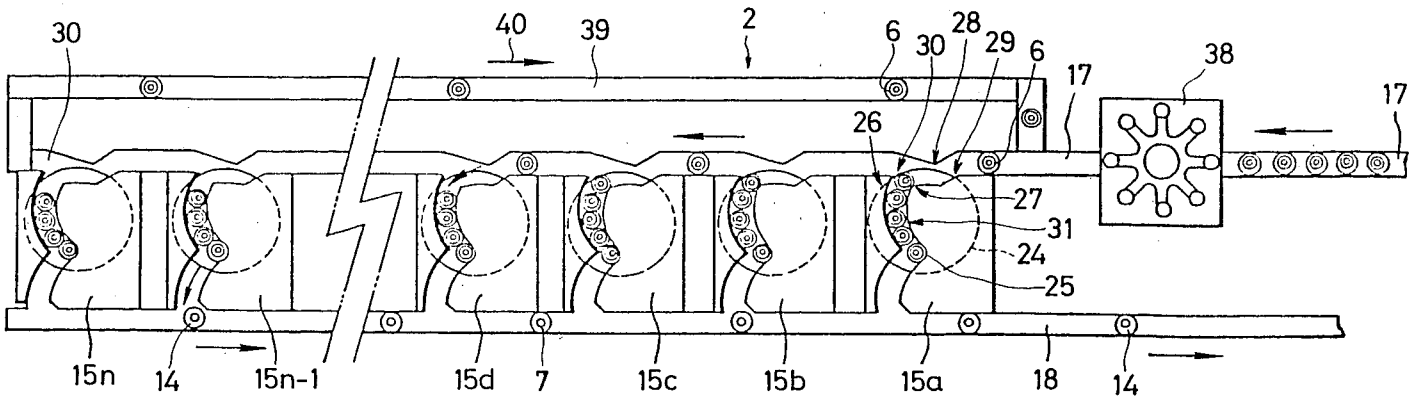
FIG. 5 is a plan showing a cop-conveying passage of the winder shown in FIG. 2.

FIG. 5 is a plan showing a cop-supplying system for supplying said winder, in which a plurality of said winding unit 15 are installed side by side with each other, with cops.

That is to say, the yarn end for knotting yarns is pulled out of cops, which were transported through said cop-conveying passage 17, by means of a yarn end readying device 38 and the cops are transported to said cop-conveying passag 17 of said winder 2 while they are fixedly inserted in trays under the condition that the yarn end is inserted in a core tube of cops. Said cop 6, which was transported through said cop-conveying passage 17, is changed onto said rotary disc 24 when said tray 14 thereof strikes said guide plates 26, 27, 28 of said winding unit 15*a* and enters said cop stand-by line 31 through said inlet 29 to arrive at said rewinding position 25. When the subsequent cops are put into said cop stand-by line 31 one after another and said 31 is filled with the appointed pieces of cop, thereby the cop, which is then sent to said cop stand-by line 31, can not enter said cop stand-by line 31, said cop is transported from said outlet 30 of an excess cop to the subsequent winding unit 15*b*.

Although said cop stand-by line 31 is filled with a tray with a cop fixedly inserted therein from said winding unit 15*a*, which is nearest said yarn end readying device 38, one after another, for example from said winding unit 15*b* to a winding unit 15*n*, if vacancies are produced in said cop stand-by line 31, the vacancies are filled one after another from said winding unit 15*a*. In addition, the cops, which could not be entered any winding units 15*a* to 15*n*, are ejected through said outlet 30 of an excess cop of the final winding unit 15*n* to enter a circulating passage 39 and then transported in the direction of an arrow 40 to be fed in said cop-conveying passage 17 again.

Figure 6:
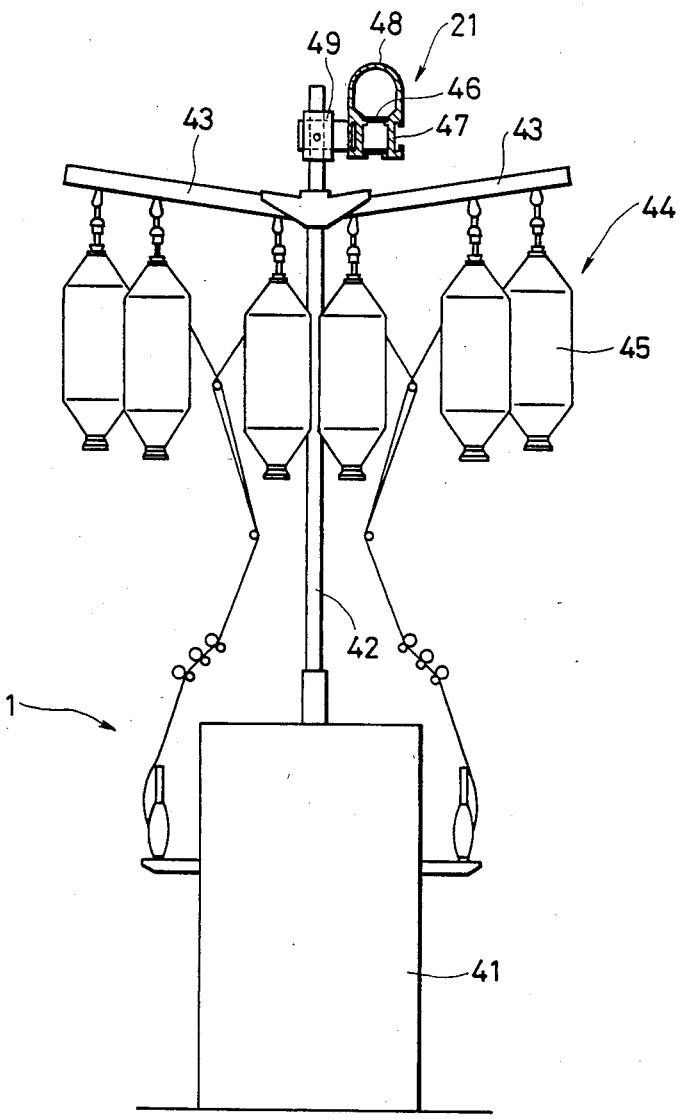
FIG. 6 is a sectional side view showing one example of an empty bobbin-conveying passage.

Referring now to FIG. 6, which is a section showing one example of said empty bobbin-conveying passage 21 shown in FIG. 2, said ring spinning frame 1 consists of the main body 42 and a sliver supply device 44 hung down from a horizontal beam 43 supported by a support 42 standing upright on said main body 41 and said empty bobbin-conveying passage 21 is installed above said support 42, that is to say above said horizontal beam 43 of a sliver 45 longitudinally along said fine spinning machine 1. Said empty bobbin-conveying passage 21 is composed of a belt conveying 46, a supporting member 47 for supporting said belt conveyor 46, a cover 48 for covering the upper portion of said belt conveyor 46, a fitting member 49 for fitting up said support 42 with said supporting member 47, and the like.

Accordingly, said empty bobbin 7, which was transported upward by means of said empty bobbin-lifting apparatus 20 shown in FIG. 2, is ejected onto said empty bobbin-conveying passage 21 through a chute 50 to be placed on a belt conveyor turning in the direction of an arrow 51 and then conveyed toward the end portion of said fine spinning machine 1. Said empty bobbin 7 is dropped in said chute 22 at the end portion of said belt conveyor and stored there, and then intermittently supplied to an empty peg on said transport band 12, which is holding in readiness below, to be fixedly inserted therein.

Furthermore, the excahnge operation of said empty bobbin 7 on said transport band 12 with a cop wound by means of said fine spinning machine, that is to say the doffing operation is carried out by means of the known automatic doffing appartus or manually according to circumstances.

Figure 7:
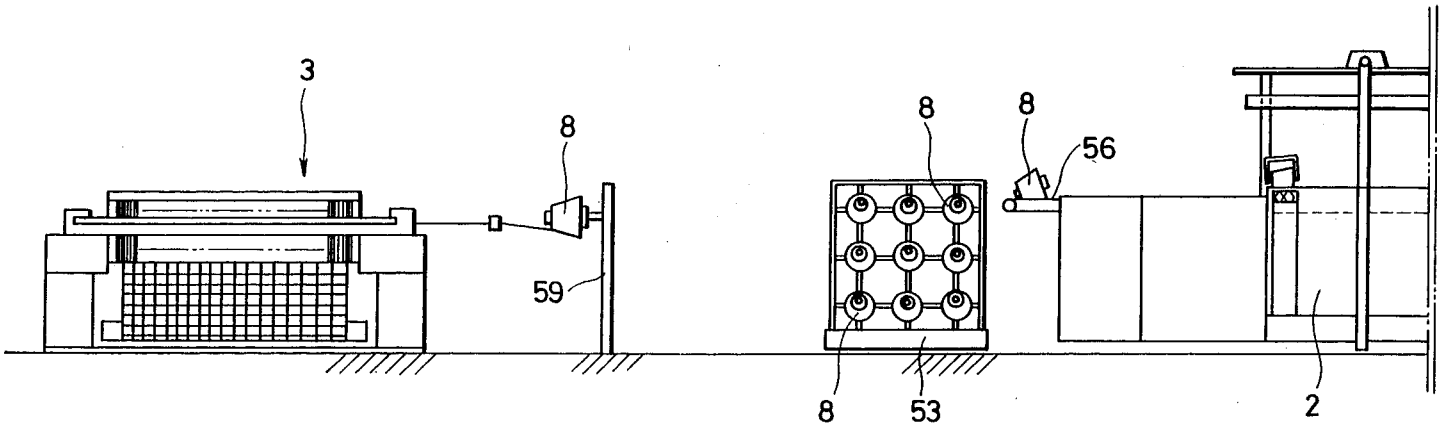
FIG. 7 is an outlined front view showing the means composing the second closed loop in the first preferred embodiment of the system according to the present invention.
Figure 8:
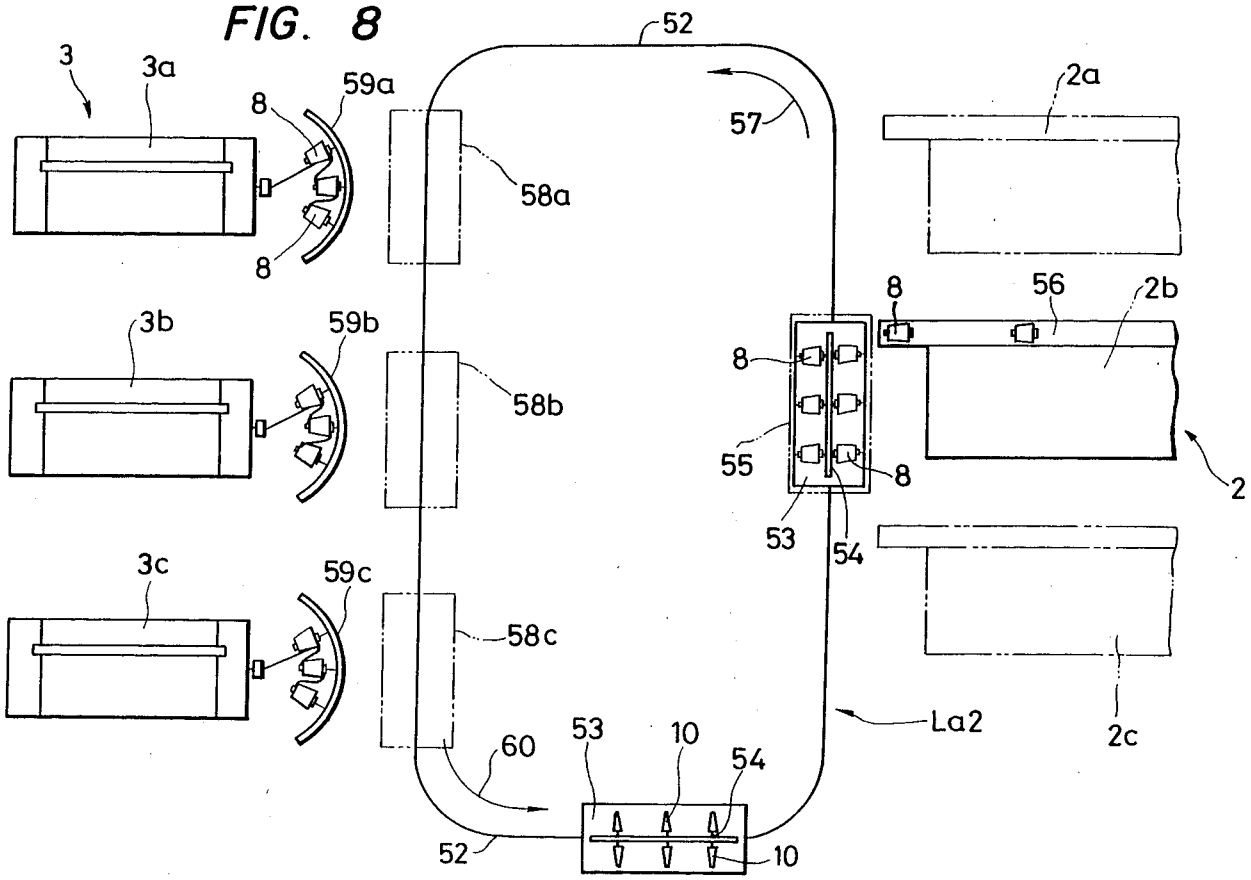
FIG. 8 is a plan showing the means shown in FIG. 7.

Then the conveying system of packages and empty paper spools between said automatic winder 2 and said weaving machine 3 or knitting machine will be described. That is to say, referring now to FIGS. 7, 8 showing the first preferred embodiment of the present invention, a car-travelling passage 52 is installed in the form of loop between said winder 2 and said weaving machine 3*a* to 3*c*, a car 53 or a plurality of car 53 being placed on said car-travelling passage 52, and said car 53 travelling with said package 8 or said empty paper spool 10 placed thereon. One of the type, which has a large number of peg 54 for supporting packages and can automatically travel and stop along said passage 52, is preferably used as said car 53. In addition, although the case, in which one automatic winder 2 and three weaving machines 3*a* to 3*c* are connected in one closed loop La2, is shown in FIG. 8, it is necessary only to determine the number of the winders and weaving machines so that it may be satisfied with the relation that the speed of yarns wound by the winders is nearly equal to that used in said weaving machines 3*a* to 3*c*. Also it is possible that a plurality of winder 2*a*, 2*b*, 2*c* are installed side by side and the group of said winders 2 and the group of said weaving machines 3 are connected in one loop-like passage 52.

In the above described system, said package 8, which was doffed from said winding unit and conveyed by means of a belt conveyor 56, is automatically inserted in said peg 54 of said car 53 manually or by means of a robot in a station 55 of winder side. Said car 53 with the appointed number of packages placed thereon is travelled in the direction of an arrow 57 along said passage 52, that is to say said package-conveying passage La2 to be stopped at a station 58*a* of weaving machine 3*a* side, where a package placed on said car is replaced with an empty paper spool of weaving machine side. When a package stand 59*a* of weaving machine side is filled with said package 8, said car 53 is travelled to the station 58*b* of the next weaving machine 3*b* by the instruction of an operator or the remote control to exchange a paper spool with a package in the same manner as described above. The same operation is carried out also in a station 58*c* for said weaving machine 3*c*. Only empty spools 10 are placed on said car 53, which was discharged from said station 58*c* or said packages 8 and said empty spools 10 are simultaneously placed on said car 53. Said car 53 is travelled on said empty paper spool-conveying passage 52 in the direction of an arrow 60 to return to said station 55 of winder side. In said station 55, said empty paper spool 10, which was conveyed thereto, is extracted from a peg of said car 53 to by supplied to an automatic doffing apparatus of winder, which will be described later, and then exchanged with said package 8 on said belt conveyor 56. The above described exchange of package in said station 55 and that in said station 58*a* to 58*c* of weaving machine side manually or automatically by means of robots, manipulators, and the like.

Then the second preferred embodiment of the conveying system according to the present invention will be described below with reference to FIGS. 9 to 12.

Figure 9:
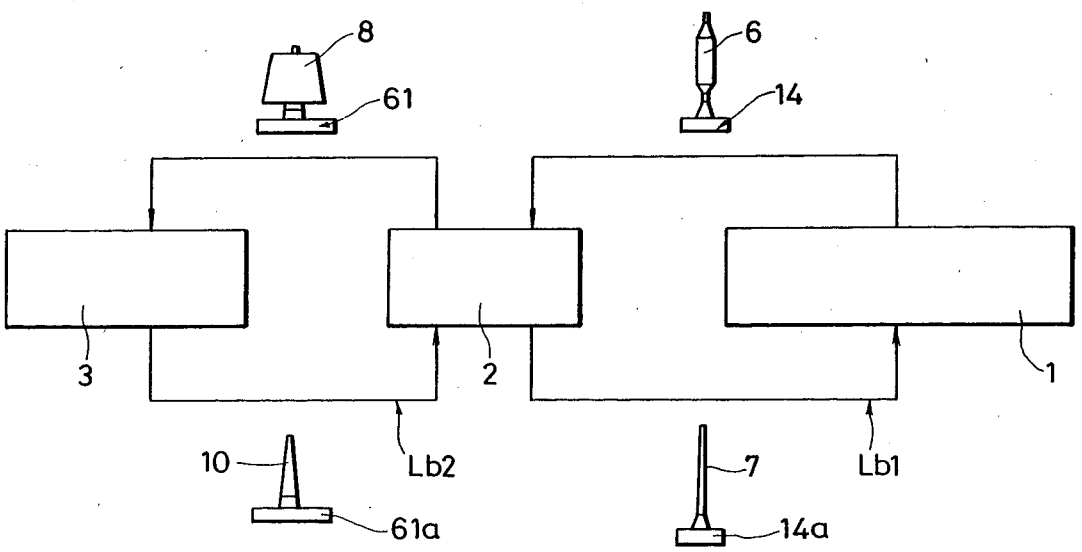
FIGS. 9 is a diagram showing the second preferred embodiment of the system according to the present invention.

Referring now to FIG. 9, said cop 6 and said empty bobbin 7 are conveyed by means of said tray 14 in said first closed cop-conveying passage Lb1 formed between said fine spinning machine 1 and said winder 2 while said package 8 and said empty paper spool 10 are conveyed by means of a tray 61 in said second loop Lb2 formed between said winder 2 and said weaving machine 3 for conveying packages in the same manner as in said first closed cop-conveying passage Lb1.

Figure 11:
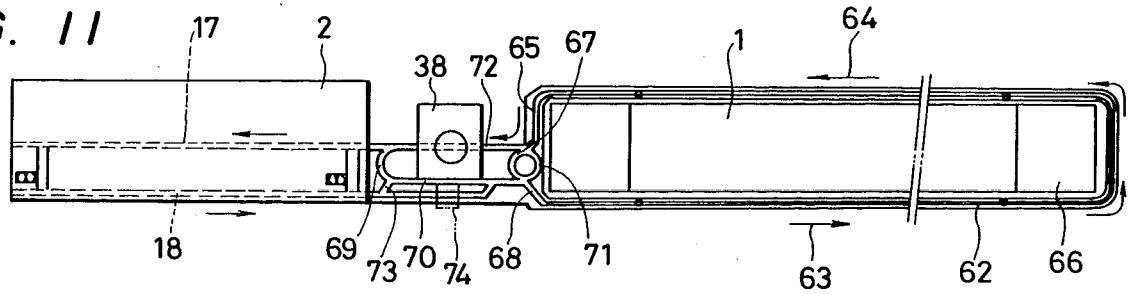
FIG. 11 is a plan showing the means shown in FIG. 10.
Figure 10:
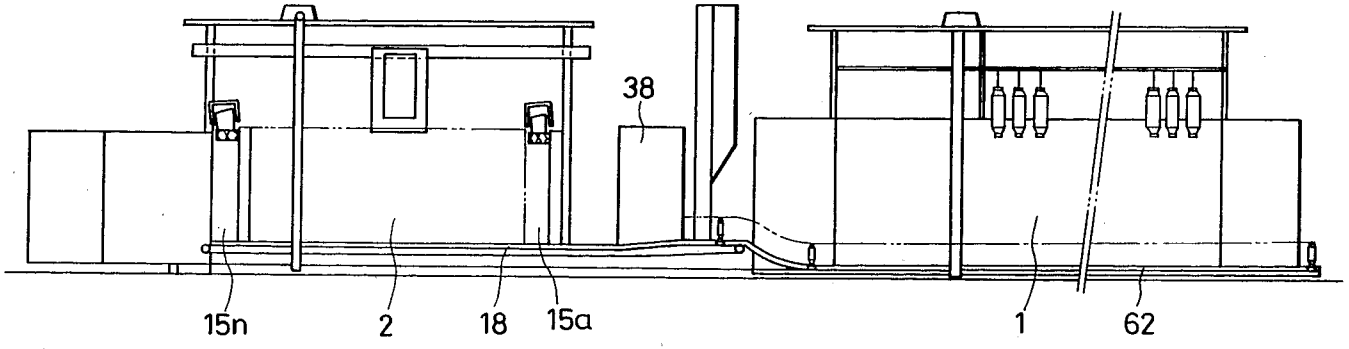
FIG. 10 is an outlined front view showing the means composing the first closed loop in the system shown in FIG. 9.

FIGS. 10, 11 show the conveying system between said fine spinning machine 1 and said winder 2. That is to say, a conveying passage 62 surrounding said fine spinning machine 1 is connected with said cop-conveying passage 17 of winder side and said empty bobbin-conveying passage 18 of winder side, said winder 2 consisting of a plurality of winding unit installed side by side shown in FIGS. 4, 5 in the same manner as in the above described preferred embodiment, an empty bobbin, which was ejected from said winder 2, being transported on said conveying passage 18 while it is inserted in said tray 14 and then transported on said conveying passage 62 of fine spinning machine 1 side in the direction of an arrow 63. In this time, the simultaneous doffing action is possible for the doffing apparatus when the trays are lined up along said fine spinning machine 1 if said trays have a diameter equal to a spindle-pitch of said fine spinning machine 1 or of ½ times said spindle-pitch. Cops, which were doffed by means of said fine spinning machine 1, are continuously or intermittently sent out in the direction of an arrow 64 from a cop-conveying passage 65 through said yarn end readying device 38. Cops, which are ready for connecting yarns, are transported to said winder 2 while they are fixedly inserted in a tray. Further, in said yarn end readying device 38, the bottom yarn of cops, which were produced by means of said fine spinning machine 1, is released, a yarn end of the appointed length being hung down in a core tube from the upper end of cop, a unit shown in FIG. 4 being used for said winding unit, and said yarn end hung down in a core tube being blown up to be sucked in a relay pipe followed by being led to a yarn-connecting apparatus.

In addition, according to this preferred embodiment of the present invention, a tray is not always filled with cops, that is to say the empty bobbins placed on the tray arranged at the end portion of said fine spinning machine 1, that is to say at the positions surrounding a gear box 66 or a control box are not exchanged with cops. Accordingly, said empty bobbins arranged at the above described positions are transported on said cop-conveying passage 65 and distinguished to be empty by means of a sensor, which detects the existence of yarn layers, when they arrive at the position of a branching-off passage 67 to be selectively transported in said branching-off passage 67 by means of a closing gate driven by a rotary solenoid (not shown). Then said empty bobbins are transported onto said empty bobbin-conveying passage 66 again. Thus merely the trays, in which cops are inserted, are supplied to said yarn end readying device 38 where an end-pulling out operation is carried out. 69 is a branching-off passage for transporting the cops, which were failed to pull out, to said yarn end readying device 38 again, the cops, which were failed to pull out, being transported from a braching-off passage 71 onto a cop-conveying passage 72 through a bypath 70 in order to pull out again.

The cops, which are conveyed in the above described manner, are automatically supplied to said automatic winder 2 and subsequently to each winding unit in the same manner as in the above described preferred embodiment in order to carry out the rewinding process. Also the empty bobbins, which are discharged after the rewinding process is completed, are transported on said empty bobbin-conveying passage 18 toward said fine spinning machine 1 while they are inserted in the tray to the position corresponding to each fine spinning spindle of said fine spinning machine 1 again where their preparation for doffing is carried out. Further, the bobbins, which are ejected from said winder 2, are not always empty. That is to say, the bobbins with residual yarns, for which it is necessary to rewind again owing to the misrelay in a winding unit, the bobbins with a remarkably small amount of residual yarns, for which it is no longer impossible to rewind again, and the like are transported on said empty bobbin-conveying passage 18 in the mixed state. Accordingly, said empty bobbin-conveying passage 18 is provided with a branching-off passage 73 for supplying the bobbins with residual yarns again to said yarn end readying device 38 at the middle thereof. Also an apparatus 74 for treating the bobbins with a remarkably small amount of residual yarns is installed at the middle of said empty bobbins-conveying passage 18. A sensor for sorting the bobbins with residual yarns is arranged directly before said branching-off passage 73. A closing gate for transporting merely the bobbins with residual yarns onto said bypath 70 is installed. Further, in said apparatus 74 for treating the bobbins with residual yarns, the bobbins with a remarkably small amount of residual yarns are distinguished from the empty bobbins which are passed therethrough to the fine spinning machine 1 side without stopping. The bobbins with a remarkably small amount of residual yarns themselves are extracted from a tray to discharge out of the loop and the new empty bobbins are supplied in a tray from the outside of the loop or residual yarns are removed from the bobbins, thereby merely the trays, in which empty bobbins are inserted, are placed on said empty bobbin-conveying passage 68 and finally they are transported to said fine spinning machine 1.

Figure 12:
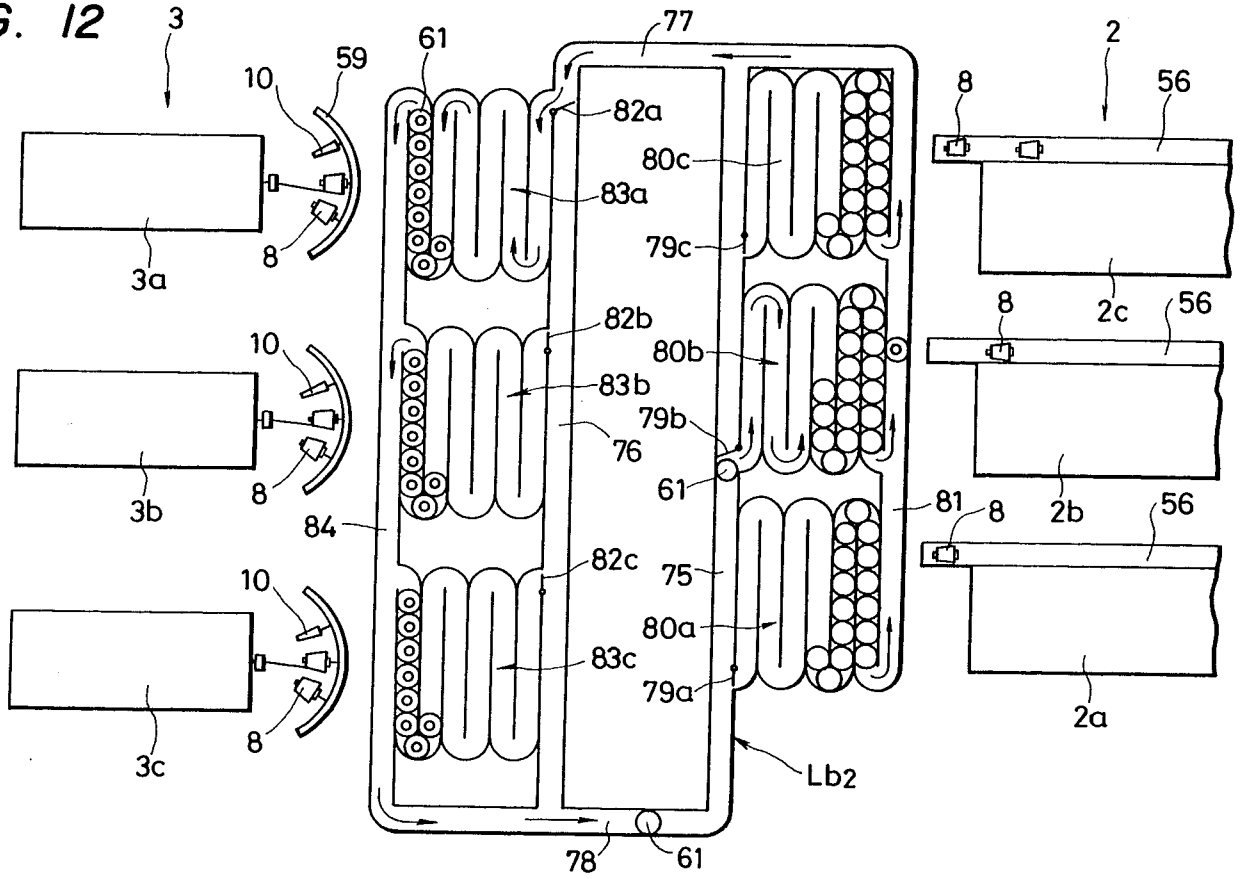
FIG. 12 is a plan showing the means composing the second closed loop in the system in FIG. 9.
Figure 14:
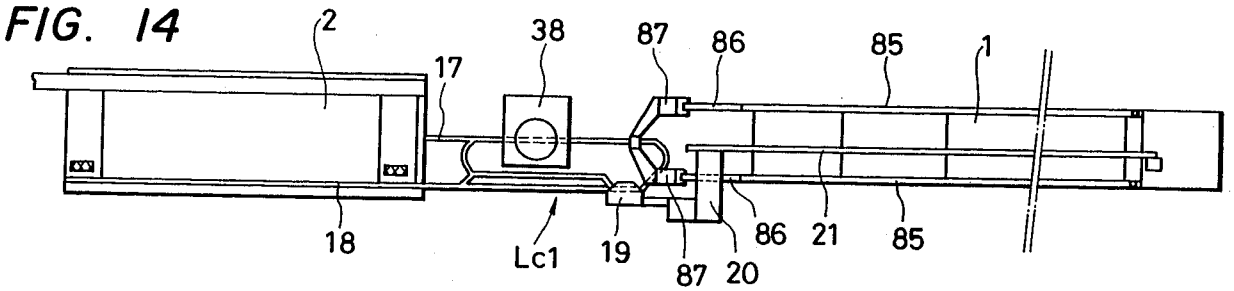
FIG. 14 is a plan showing the means shown in FIG. 13.
Figure 13:
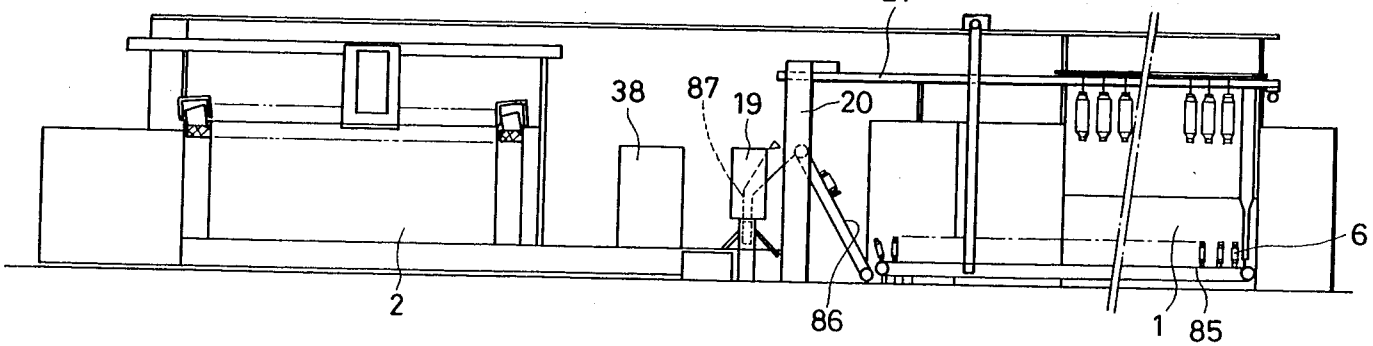
FIG. 13 is an outlined front view showing the means composing the first closed loop in the third preferred embodiment of the system according to the present invention.

FIG. 12 shows the second preferred embodiment of the conveying system of weft yarn package which is formed between said winder 2 and said weaving machine 3. Referring now to FIG. 12, a passage Lb2 for conveying the trays (61 in FIG. 9), in which the packages are independently inserted, is formed in the form of a closed loop between said winder 2 and said weaving machine 3. This closed loop Lb2 basically comprises conveying passages 77, 78 which communicate the first conveying passage 75 extending in the direction along the end portion of said winder 2 with the second conveying passage 76 extending along the side of said weaving machine 3. Said conveying passages 77, 78 are composed of a belt conveyor, a guide plate, and the like. Said conveying passages 78, 75 are those for conveying empty paper spools from the weaving machine side to the winder side while said conveying passages 77, 76 are those for conveying full packages from the winder side to the weaving machine side.

Tray-storage passages 80*a*, 80*b*, 80*c* for each winder 2*a*, 2*b*, 2*c* are branched-off from said first conveying passage 75 through moveable gates 79*a*, 79*b*, 79*c*, each of said tray-storage passages 80*a*, 80*b*, 80*c* being connected with a conveying passage 81, and said conveying passage 81 being connected with said package-conveying passage 77. That is to say, said trays 61 with empty paper spools, which were returned from each of said weaving machines 3*a*, 3*b*, 3*c*, inserted therein are stored in said tray-storage passages 80*a*, 80*b*, 80*c*, empty paper spools being extracted from trays manually or by means of robots and the like and supplied to a doffer which will be described later, packages, which were conveyed to the end portion of said winder 2 through said package-conveying passage 56, being inserted in empty trays, which are stored in said tray-storage passages, one after another, and trays with said packages inserted therein being supplied to the weaving machine side through said conveying passages 81, 77, 76.

On the other hand, in the weaving machine side, package-storage passages 83*a*, 83*b*, 83*c* for each weaving machine are branched-off from said second conveying passage 76 through movable gates 82*a*, 82*b*, 82*c*, each of said package-storage passages 82*a*, 82*b*, 82*c* being connected with a conveying passage 84, and said conveying passage 84 being connected with the winder side through said conveying passage 76. That is to say, packages, which were doffed from the winder side, inserted in trays, and conveyed, are brought in said package-storage passages 83*a*, 83*b*, 83*c* for said weaving machines 3*a*, 3*b*, 3*c*. If at first said movable gate 72*a* is set to the position shown by a full line, said trays 61 with packages, which were transported from said conveying passage 77, inserted therein are brought in said package-storage passage 83*a* one after another. When the apointed number of packages is brought in said package-storage passage 83*a*, it is detected by means of a sensor and the like that the appointed number of packages was brought in said package-storage passage 83*a* to close said gate 82*a* and open said gate 82*b* of the next package-storage passage 83*b*. Thus the appointed number of packages is brought in said package-storage passage 83*b* in the same manner as in said package-storage passage 83*a*. Also said package-storage passage 83*c* comes to the same thing. Further, if all of said package-storage passage 83*a*, 83*b*, 83*c* are filled with packages, said gates 82*a*, 82*b*, 82*c* are closed, thereby packages, which were supplied to said second conveying passage 76, are circulated in said conveying passages 76, 78, 75, 77 without being brought in said package-storage passages.

Accordingly, after the yarn layer of the packages supported by means of a package-stand 59 of said weaving machine 3 is used up and said empty paper spool 10 is extracted from said stand 59 manually or by means of a robot and the like, the aforemost one of packages, which are stored on said package-storage passages 83*a*, 83*b*, 83*c*, is supported by said stand 59. The tray with empty paper spools inserted therein is transferred to the winder side through said conveying passages 78, 75 in the above described manner.

In addition, in the above described preferred embodiment, the packages and the empty paper spools are transported at random without the corresponding relation between said winders 2a, 2b, 2c and said weaving machines 3a, 3b, 3c if the same kind of yarn is rewound by said winders 2a, 2b, 2c and the textile goods, in which the same kind of weft yarn is used, are woven by said weaving machines 3a, 3b, 3c. In addition, the circulation of trays in said tray-circulating system can be carried out without changing said conveying passages even when different kinds of yarn are wound by said winders and the specified yarn is supplied to the specified weaving machine. That is to say, the specified weaving machine. That is to.say, the specified packages and empty paper spools can be brought in the specified storage passages by detecting the discrimination marks put on the trays by means of discrimination sensors, such as a mark sensor for detecting the color of tray, an adjacency sensor, and a touch sensor, which are arranged dirctly before the movable gates of said empty paper spool-storage passages 80a, 80b, 80c and said package-storage 83a, 83b, 83c.

In addition, according to the above described first and second preferred embodiments, all of said trays 14 for conveying the cops, which were obtained by said fine spinning machine 1 and inserted therein, and said trays 61 for conveying the packages, which are inserted therein, such as cheeses and cones in said second preferred embodiment comprise a disc type bed 14a, 61a with pegs set up thereon, cops, packages, and the like being put on said pegs upright, and each cop and package being independently transported by placing said beds 14a, 61a on the belt conveyor. In this time, the diameter of said bed 14a of trays (14 in FIG. 9) for cops is larger than at least the largest diameter of the yarn layer of said cop 6 and the diameter of said bed 61a of trays (61 in FIG. 9) for packages is larger than at least the largest diameter of the yarn of said package 8. Accordingly, when the trays are continuously transported, the cops, which are placed on said trays 14, are not brought into contact with the yarn layer of the adjacent top, and further the packages, which are placed on said trays 61, are transported without being brought into contact with the yarn layer of the adjacent package, thereby the surface of the yarn layer is not injured during its transportation. In this respect, also in the case when said car (53 in FIG. 7) is used, the same effect as the above described can be attained by positioning the pegs for supporting said car 53 at the suitable intervals.

Then the third preferred embodiment of the present invention will be described with reference to FIGS. 13 to 16. That is to say, referring to FIGS. 13, 14, the first closed loop Lc1 is composed of said fine spinning machine 1, said winder 2, said cop-conveying passage 17, and said empty bobbin-conveying passage 18, said cops 6 doffed by said fine spinning machine 1 being transported to the end portion of said fine spinning machine 1 by means of a transport-band 85 provided with pegs, the cops, which were extracted from pegs, are moved from the end portion of said fine spinning machine 1 onto an inclined belt conveyor 86. Then the cops are thrown down in an automatic cop-supplying apparatus 87 from the upper end of said inclined belt conveyor 86 and then inserted in the peg-trays (shown in FIG. 1), which hold in readiness below, to be transported to said winder 2 through said conveying passage 17. Said winder 2 consists of a plurality of winding unit, which are similar to the winding unit shown in FIG. 4, installed side by side. After the cops are supplied and the empty bobbins are discharged in the above described manner, the empty bobbins, which were conveyed through said empty bobbin-conveying passage 18, are extracted from the trays by means of said empty bobbin-treatment apparatus 19 and then transported to the end portion of said fine spinning machine 1 through said empty bobbin-lifting apparatus 20 by means of said empty bobbin-conveying passage 21 installed above said fine spinning machine 1. Then the cops are put on the pegs provided on said transport band 85, which holds in readiness below, through said chute 22.

Figure 15:
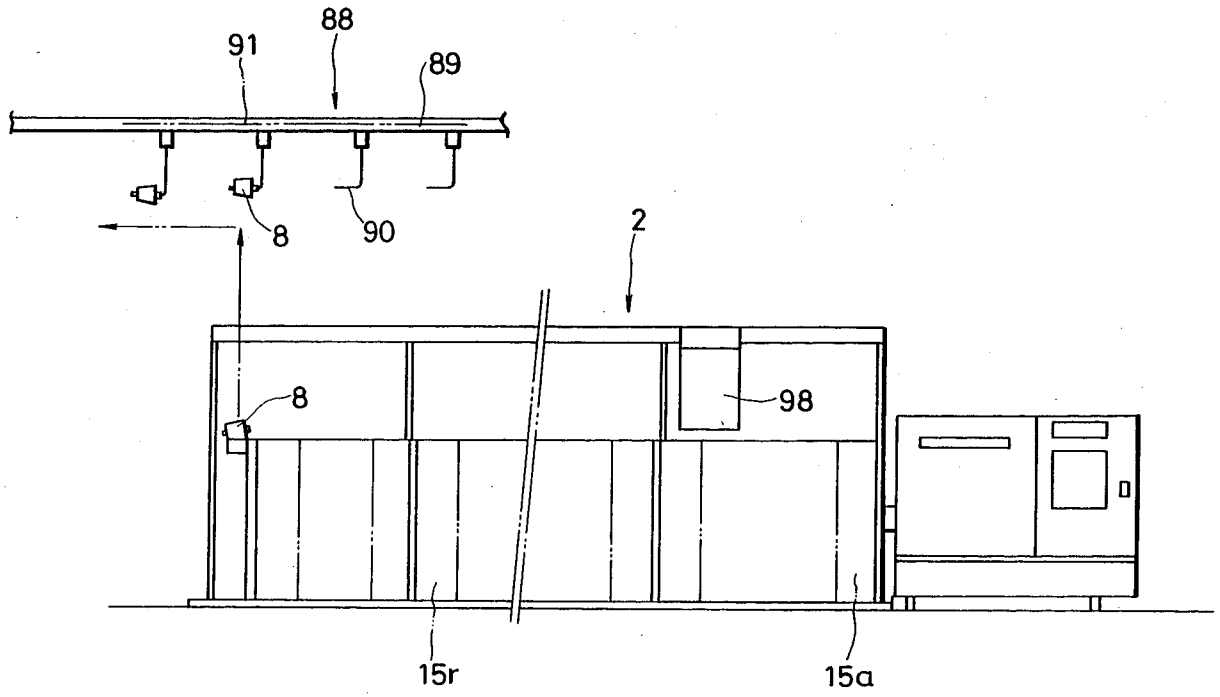
FIG. 15 is a diagram showing a package-conveying means in the system shown in FIG. 13.
Figure 16:
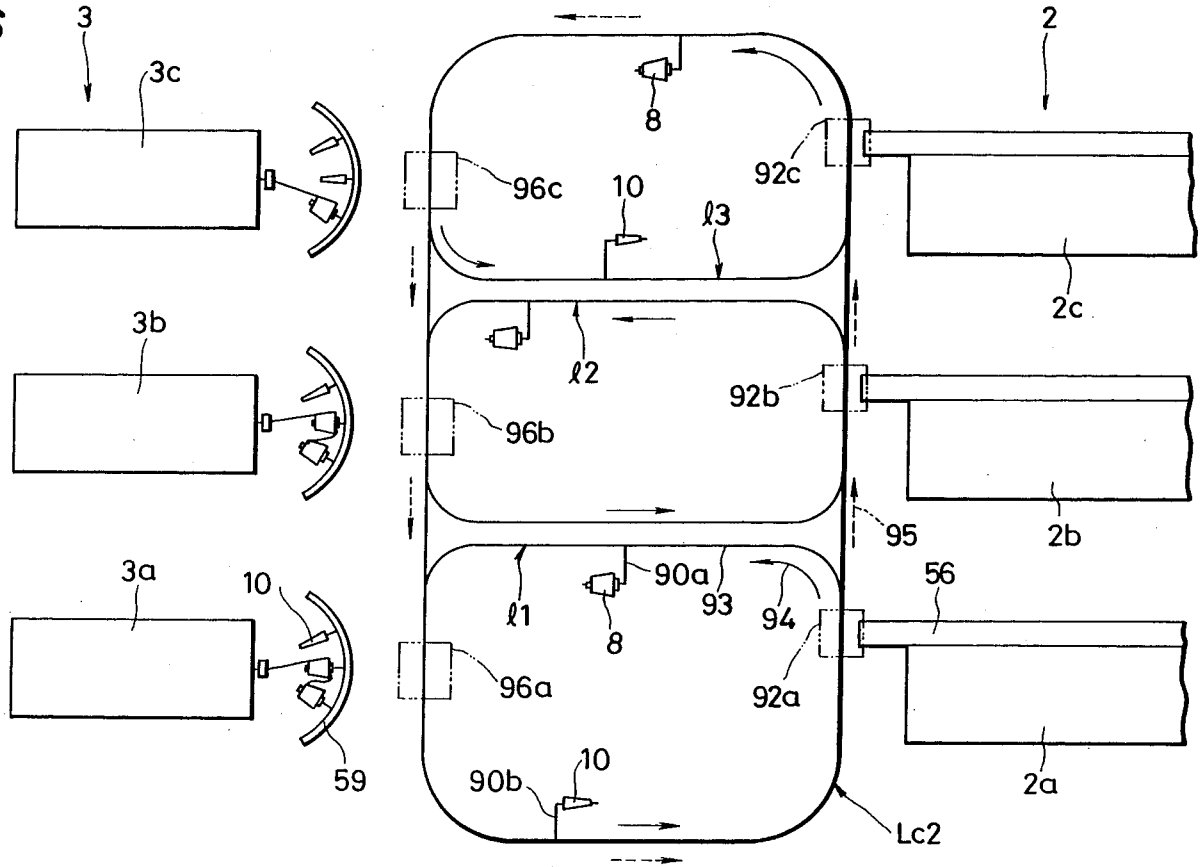
FIG. 16 is a plan showing the means composing the second closed loop in the system shown in FIG. 13.

Referring now to FIGS. 15, 16 showing a system for conveying full packages, which were wound by means of said winder 2, to the weaving machine side, said winders 2a, 2b, 2c are directly connected with said weaving machines 3a, 3b, 3c in the form of the closed loop Lc2 through a hook-conveyor 88 traveling at the definite height from the floor. Said hook-conveyor 88 comprises a chain 91 travelling along a guide rail 89 installed in the form of closed loop, said chain 91 being provided with L-type hooks 90 vertically hung down therefrom at intervals, and said packages 8 or said empty paper spools 10, which are inserted in said hooks 90, are circulated in the loop consisting of said winder 2 and said weaving machine 3. Referring to FIG. 16, if said package 8, which is placed on said belt conveyor 56, is exchanged with said empty paper spool 10, which is inserted in the tray, on a station 92a and a hook 90a, from which said package 8 is hung down, is transported through a conveying passage 93 in the direction of an arrow 94, the packages, which were doffed by said winder 2a, are supplied merely to said weaving machine 3a. However, in the case when said hook 90a is transported in the direction of an arrow 95, the packages can be supplied to all of said weaving machines 3a, 3b, 3c. The packages hung on said hooks are extracted at a station 96a of the weaving machine side and then inserted in said package-stand 59 of the weaving machine while said empty paper spool 10 is hung by a hook 90b and returned to the winder side. Accordingly, it is necessary only to circulate packages along a small loop l1 or said large loop Lc2 while they are hung on said hooks when said stand 59 of the weaving machine side is full of packages.

Although the conveying system for the case, in which the packages wound by said winder 2 are used as weft yarns in the weaving machine, is described in each of the above described preferred embodiments, the packages can be used as warps, too, in the weaving machine by directly connecting a warping machine with said winder through a package-conveying closed loop. In this time, it is necessary to form said closed loop so that the suitable number of winding units may correspond to said warping machine on the basis of the relation between the speed of warps used in said warping machine and the winding speed thereof in said winder. In addition, the similar closed loop for conveying packages and empty paper spools may be formed between said winder 2 and a knitting machine.

Then one example of a doffer and an empty paper spool-supplying apparatus of said automatic winder 2 used in each of the above described preferred embodiments will be described.

Figure 17:
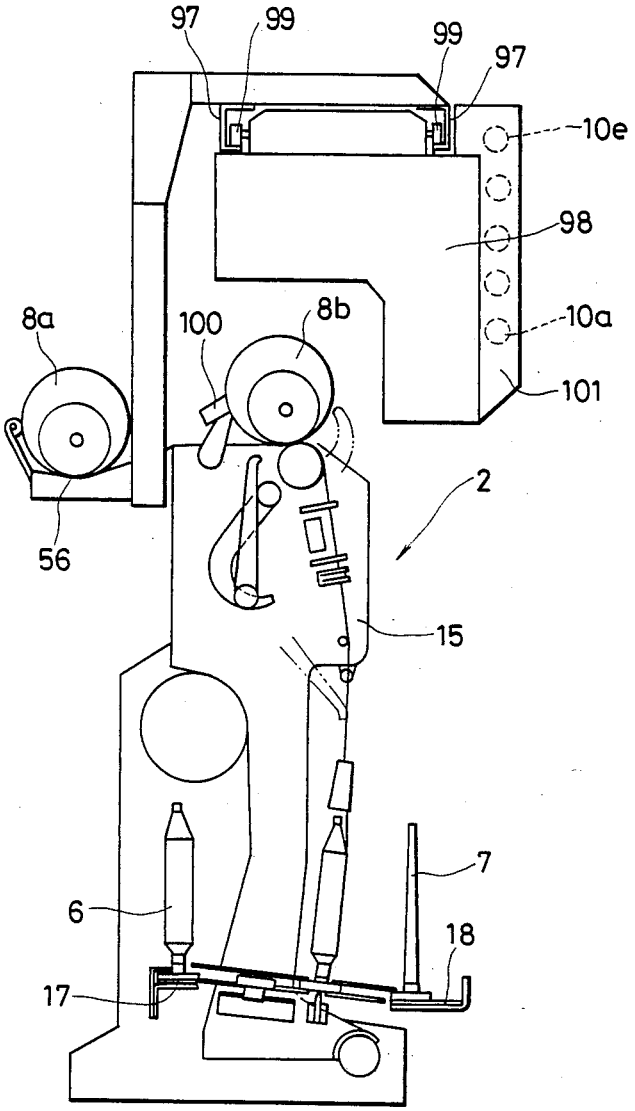
FIG. 17 is a side view showing a doffer and a package-conveying means of the winder used in the above described preferred embodiments.
Figure 18:
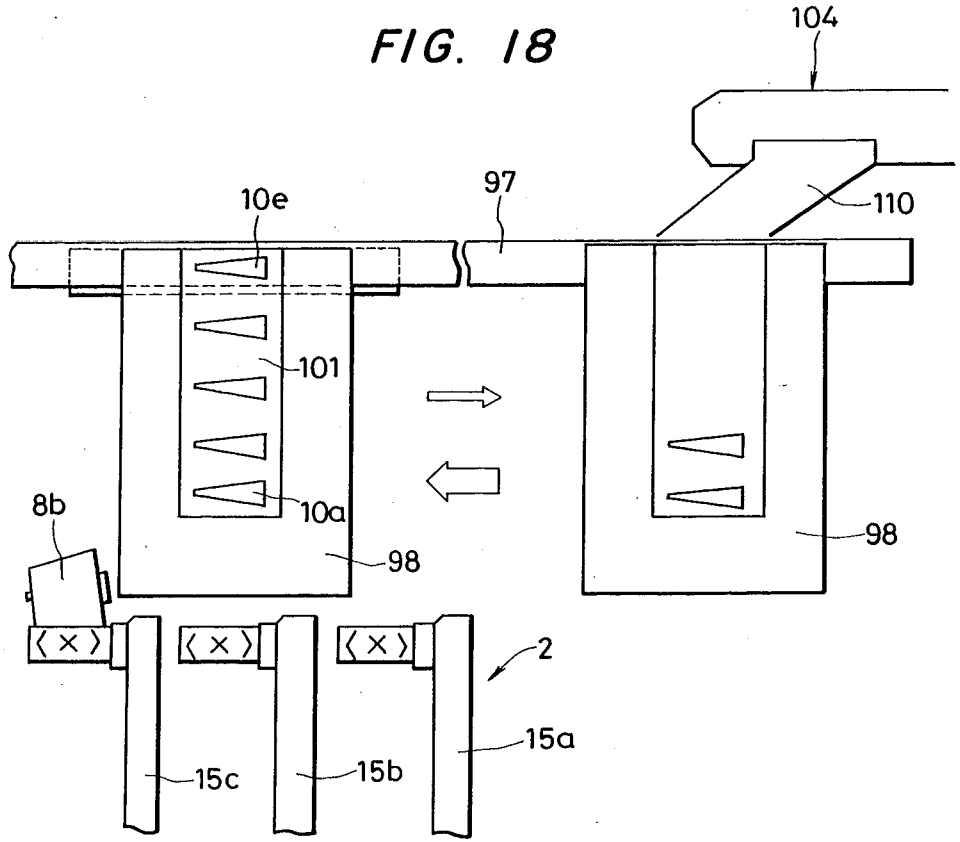

Referring now to FIGS. 17, 18, a ceiling rails 97, 97 are installed along a winding unit 15 of said winder 2 over said winding unit 15, a traveling member 98 provided with a doffer being hung down from said rails 97, 97, and said belt conveyor 56 for conveying a package 8a, which was doffed along the back portion of said winder 2, toward the end portion of said winder 2 being installed, too. Said travelling member 98 is provided with a doffing mechanism (not shown), namely a package-extracting mechanism for seceding said full package 8*b*, which is supported by a cradle arm 100 of said winding unit, from said cradle arm 100 and placing it on said belt conveyor 56, an empty paper spool-mounting mechanism for mounting an empty paper spool 10*a* to 10*e*, which is housed in said travelling member 98, on said cradle arm 100, and the like, said travelling member 98 traversing or circulating along said winding units and stopping the travel thereof when it arrives at the position of said winding unit, to which the doffing instruction is given, so that the doffing operation may be carried out. The appointed numer (five in the drawing) of said empty paper spools 10*a* to 10*e* are separately housed in a paper spool-housing box 101 of said travelling member 98 and supplied one after another to said winding unit 15, starting from the lowermost one 10*a*. When said travelling member 98 arrived at the end portion of traverse, said box 101 is automatically filled with empty paper spools if there are vacancies in said box 101. That is to say, the actuator can be installed so that an empty paper spool-conveying apparatus may be actuated when a paper spool came to the end portion of traverse by detecting the existence of a paper spool by means of a feeler, which is installed at the position of the uppermost paper spool 10*e*, for detecting the existence of a paper spool.

Figure 19:
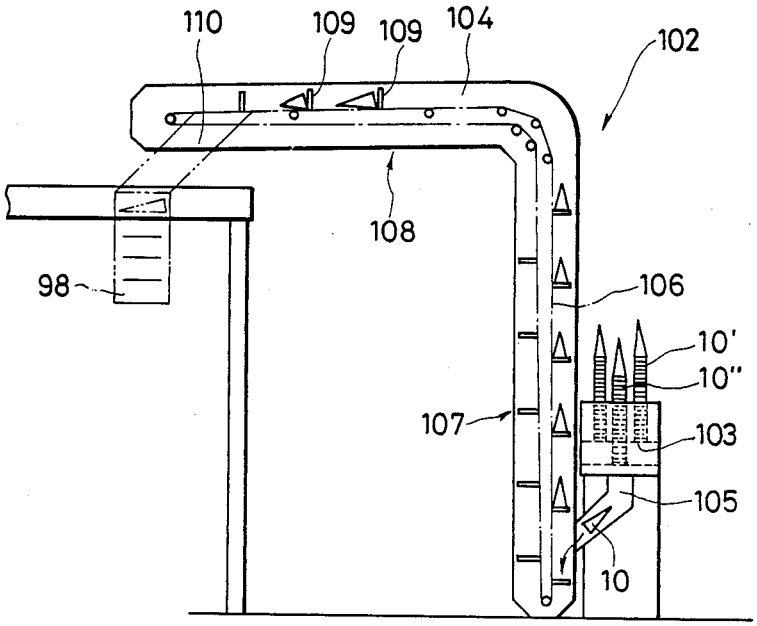

An empty paper spool-supplying apparatus 102 for supplying empty paper spools to said travelling member will be described with reference to FIG. 19. Said empty paper spool-supplying apparatus 102 consists of a paper spool stock, a separating portion 103, and a paper spool-conveying passage 104. In the case shown in FIG. 19, the lowermost paper spool belonging to one group of paper spools 10″ separated from the paper spool positioning above said lowermost paper spool one by one by means of a separating mechanism (not shown) and supplied from said stock portion 103, in which the stack 10′ of tapered paper spools 10 is housed, onto a belt conveyor 106 through a chute 105. Said belt conveyor 106 intermittently moves one pitch by one pitch to be transported from a vertical portion 107 to a horizontal portion 108 and moves by one pitch by the instruction for requiring paper spool given from said travelling member 98 at the end portion of said horizontal portion 108. That is to say, one piece of paper spool located between partition plates 109 is thrown in a chute 110 and then dropped in said paper spool-housing box 101 of said travelling member 98. The above described operation is continued until the feeler, which is positioned at the position of the uppermost paper spool in said box 101, detects a paper spool. If said box 101 is filled with paper spools, the movement of said belt conveyor 106 and the action of said cutting out mechanism are stopped, thereby the supply of paper spools to said travelling member 98 is completed.

Accordingly, it is necessary only to place said empty paper spools 10, which are returned from said weaving machine 3 through said second closed loops La2, Lb2, Lc2, on said paper spool stacks 10′, 10″ in said stock portion 103 in order to automatically supply the empty paper spools from said travelling member 98 to winding units.

In the above described conveying system, spinning yarns, which were produced by said fine spinning machine 1, are conveyed to said automatic winder 2 through said first closed loops La1, Lb1, Lc1, empty bobbins, which were emptied by winding up yarns, being returned again to said fine spinning machine 1 through said closed loops La1, Lb1, Lc1. In this time, empty bobbins, which are descharged from said winder, can be successively returned to the fine spinning machine side even while the cops are being supplied to said winder by directly connecting said fine spinning machine 1 with said winder 2 through said closed loops. Further, although there are no problems if the yarn-producing capacity of the fine spinning machine corresponds to the yarn-treating capacity of the winder, in general, they do not always correspond to each other because of troubles in machineries, changes in the kind of yarns produced, changes in the lot number, and the like. In this time, the excess cops are produced if the yarn-producing capacity of the fine spinning machine exceeds the capacity of the winder. But it is not necessary to change the capacity of the fine spinning machine by reserving said excess cops in said cop-conveying passagae 17 of said closed loops La1, Lb1, Lc1 or circulating said excess cops in said closed loop 39 formed in said winder 2 as shown in FIG. 5. On the contrary, if the capacity of the winder exceeds the yarn-producing capacity of the fine spinning machine, said excess cops can be rewound or many kinds of yarn can be rewound by one winder. That is to say, if a plurality of fine spinning machine are directly connected with a plurality of winder in the form of the closed loop, the capacity of the winder can be adjusted to the producing capacity of the fine spinning machine by increasing or decreasing the number of winding units of the winder.

The same thing as the above described is possible for the closed loops La2, Lb2, Lc2 formed between said winder 2 and said weaving machine 3 or knitting machine, too. That is to say, the rate of packages in the closed loops can be freely controlled by installing a package-reserving portion and a bypath portion at the weaving machine side.

As described above, according to the present invention, a fine spinning machine is directly connected with a winder through the first closed loop for conveying cops and empty bobbins, said winder being connected with a weaving machine through the second closed loop for conveying packages and empty paper spools, the yarn-conveying media for the exclusive use in each loop, namely bobbins in the first closed loop and paper spools in the second closed loop, being circulated in each loop, thereby spinning yarns can be smoothly conveyed from the fine spinning machine to the winder and from the winder to the weaving machine. Further, the conveying system having the flexibility can be attained by connecting the specified fine spinning machine, winder, and weaving machine through two closed loops even in the small amount production. In addition, the fine spinning process to the weaving process can be continuously carried out in one factory. For example, the intermediate operations such as the operation for conveying a box, in which cops are housed at random, and the operation for transporting packages one by one to the textile manufacturing factory in the packaged form can be omitted. Further, the chances, at which the operators are brought into contact with the yarn layer of cops and packages, are reduced, thereby the quality of yarns is not deteriorated.

In addition, the fine spinning machine and the winder can be easily changed over so that they may be adjusted to the production of many kinds of textile in a small lot.

That is to say, the lot can be easily changed over by installing a plurality of conveying systems directly connected with each other through said two closed loops.

Further, it is necessary only to inspect the winder and the fine spinning machine in order to make clear whether the defects of textiles are resulted from some troubles in the winder directly connected with the weaving machine through the closed loop or some troubles in the fine spinning process. That is to say, the sources of the defects can be easily brought to light; the quality of textiles and the quality of yarns can be fed back to the proceding process; and thus the quality control of yarns can be carried out.

What is claimed is:

1. A yarn-conveying system comprising:

a first closed loop including a cop conveying sub passage transporting cops from a yarn spinner to a winding machine and a bobbin conveying sub passage transporting empty bobbins from the winding machine to the yarn spinner; and a second closed loop including a defined yarn package and spool conveying sub passage transporting yarn packages and empty spools between the winding machine and at least one weaving machine, wherein yarn formed by the spinner is directly conveyed to an associated winding machine and associated weaving machines;

wherein said first closed loop comprises:

means for preparing cops for the winding machine;

a first conveying passage transporting cops and bobbins from individual spinner units of the spinner to the cop preparing means;

a second conveying passage transporting cops from the cop preparing means to individual winder units of the winding machine;

first means for separating out bobbins, returning from the individual winder units, having a predetermined first minimum amount of yarn;

a third conveying passage transporting bobbins from the individual winder units to the first bobbin separating means;

a fourth conveying passage transporting bobbins from the first bobbin separating means to the individual spinner units of the spinner;

means, disposed adjacent the cop preparing means, for distinguishing cops from bobbins and transporting bobbins to the fourth conveying passage; and second means, disposed adjacent the first bobbin separating means, for separating bobbins, returning from the individual winder units, having a pre-determined second minimum amount of yarn and transporting these bobbins to the cop preparing means.

2. The yarn-conveying system of claim 1 further comprising means for conveying empty spools from the yarn package and spool sub passage to a travelling doffer unit of the winding machine.

* * * * *